US010968707B2

(12) United States Patent
Billington et al.

(10) Patent No.: US 10,968,707 B2
(45) Date of Patent: Apr. 6, 2021

(54) SUBSEA METHANE HYDRATE PRODUCTION

(71) Applicant: Aker Solutions AS, Lysaker (NO)

(72) Inventors: Anders Billington, Lommedalen (NO); Neil Ryan, Holmestrand (NO); Alexander Paul Lazell, Oslo (NO); Jan Herland, Nesbru (NO); Edin Pita, Drammen (NO)

(73) Assignee: Aker Solutions AS, Lysaker (NO)

( * ) Notice: Subject to any disclaimer, the term of this patent is extended or adjusted under 35 U.S.C. 154(b) by 0 days.

(21) Appl. No.: 15/767,331

(22) PCT Filed: Aug. 23, 2016

(86) PCT No.: PCT/NO2016/050173
§ 371 (c)(1),
(2) Date: Apr. 10, 2018

(87) PCT Pub. No.: WO2017/111607
PCT Pub. Date: Jun. 29, 2017

(65) Prior Publication Data

US 2018/0298702 A1 Oct. 18, 2018

(30) Foreign Application Priority Data

Dec. 22, 2015 (NO) ..... 20151782

(51) Int. Cl.
*E21B 19/00* (2006.01)
*E21B 43/01* (2006.01)
(Continued)

(52) U.S. Cl.
CPC ..... *E21B 19/002* (2013.01); *E21B 19/24* (2013.01); *E21B 41/0021* (2013.01);
(Continued)

(58) Field of Classification Search
CPC .... E21B 19/002; E21B 19/24; E21B 41/0021; E21B 43/01; E21B 43/0135; E21B 2043/0115
See application file for complete search history.

(56) References Cited

U.S. PATENT DOCUMENTS 8,232,438 B2 * 7/2012 Jones ..... E21B 43/34 585/15
8,381,820 B2 * 2/2013 Martinez ..... E21B 43/128 166/105
(Continued)

FOREIGN PATENT DOCUMENTS

EP 0357180 A1 3/1990
JP H10-311191 A 11/1998
(Continued)

OTHER PUBLICATIONS

Matsuzawa, M., et al., "A Completion System Application for the World's First Marine Hydrate Production Test," Offshore Technology Conference, Houston, TX, May 5-8, 2014, pp. 1-22.
(Continued)

*Primary Examiner* — Aaron L Lembo
(74) *Attorney, Agent, or Firm* — Shackelford, Bowen, McKinley & Norton, LLP

(57) ABSTRACT

An offshore methane hydrate production assembly (1), having a tubing (41) extending into a subsea well (5) that extends down to a methane hydrate formation (7) below the seabed (3). A submersible pump (45) is arranged in the tubing (41). A methane conduit (35,35) extends down from a surface installation (49). A well control package (15) landed on a wellhead (13) is positioned at the upper end of the subsea well (5). Moreover, an emergency disconnection package (25) is arranged between the methane conduit (35,135) and the well control package (15). The tubing (41)
(Continued)

is suspended from the well control package (15). Other aspects of the invention are also disclosed.

8 Claims, 11 Drawing Sheets

(51) Int. Cl.
*E21B 19/24* (2006.01)
*E21B 41/00* (2006.01)
*E21B 43/013* (2006.01)

(52) U.S. Cl.
CPC ..... *E21B 43/01* (2013.01); *E21B 43/0135* (2013.01); *E21B 41/0099* (2020.05)

(56) References Cited

U.S. PATENT DOCUMENTS

| | | | | |
|---|---|---|---|---|
| 9,109,420 | B2 * | 8/2015 | Tindle | E21B 33/035 |
| 9,695,665 | B2 * | 7/2017 | Older | E21B 43/013 |
| 9,784,063 | B2 * | 10/2017 | June | E21B 33/035 |
| 9,874,065 | B2 * | 1/2018 | Christensen | E21B 17/01 |
| 10,246,970 | B2 * | 4/2019 | Deacon | E21B 34/02 |
| 2005/0028980 | A1 | 2/2005 | Page et al. | |
| 2007/0016780 | A1 | 1/2007 | Lee et al. | |
| 2007/0163780 | A1 | 7/2007 | Onodera et al. | |
| 2009/0057011 | A1 | 3/2009 | Petersson et al. | |
| 2015/0047850 | A1 | 2/2015 | Johnson | |
| 2015/0330194 | A1 * | 11/2015 | June | E21B 17/003 166/351 |

FOREIGN PATENT DOCUMENTS

| | | | |
|---|---|---|---|
| JP | 2004-108132 | A | 4/2004 |
| JP | 2004-321952 | A | 11/2004 |
| JP | 2006-046009 | A | 2/2006 |
| JP | 2006-307446 | A | 11/2006 |
| JP | 2009-520138 | A | 5/2009 |
| JP | 2013-170374 | A | 9/2013 |
| WO | WO-2007072172 | A1 | 6/2007 |
| WO | WO-2012061027 | A1 | 5/2012 |
| WO | WO-2013169099 | A2 | 11/2013 |
| WO | WO-2016085329 | A1 | 6/2016 |
| WO | WO-2016104448 | A1 | 6/2016 |

OTHER PUBLICATIONS

Wikheim, Martin N., "International Search Report," prepared for PCT/NO2016/050173, as filed Feb. 28, 2017, five pages.

* cited by examiner

SUBSEA METHANE HYDRATE PRODUCTION

The present invention relates to a method and an associated assembly for production of methane from a methane hydrate formation below the seabed. In particular, the invention makes use of equipment known from the field of subsea oil and gas workover operations for the methane production.

BACKGROUND

Vast amounts of naturally occurring methane hydrates, sometimes referred to as methane clathrate, exist. Typical areas of such formations are in the permafrost regions and below the seabed where there is a certain pressure. Within the oil and gas field, methane hydrate is a well-known substance, as it tends to form within hydrocarbon-conducting flow pipes, and thereby block such pipes.

Below a certain temperature and/or above a certain pressure, methane hydrate stays as a solid. By increasing temperature and/or by reducing pressure, it will dissolve into methane and water. Another way to dissolve it, is to inject inhibitors such as methanol, to shift the pressure-temperature equilibrium. International patent application publication WO2012061027 gives an introduction to this topic.

Being a possible energy resource for many countries, research has been performed to investigate how to produce methane from subsea formations. Methane is a significant greenhouse gas. Thus, the methane must be prevented from escaping into the atmosphere. Also, compared to the well-known production from oil and gas formations, producing methane from a solid state may require a different approach.

One known manner to produce methane from such formations, is to lower the pressure in the formation, thereby making the hydrate split into methane and water.

An object of the present invention is to provide a solution for production of methane from a subsea methane hydrate formation in an efficient manner, preferably both with respect to time and costs.

THE INVENTION

According to a first aspect of the present invention, there is provided an offshore subsea well. The subsea well extends down to a methane hydrate formation below the seabed. A submersible pump arranged is in the tubing, i.e. as a part of the tubing. A methane conduit extends down from a surface installation, towards the seabed. A well control package is landed on a wellhead and is positioned at the upper end of the subsea well. Moreover, an emergency disconnection package is arranged between the methane conduit and the well control package. According to the first aspect of the present invention, the tubing is suspended from the well control package.

In some embodiments, methane and water are separated subsea and conducted to the surface installation in separate conduits, i.e. a methane conduit and a water conduit. In other embodiments, methane and water may be conducted in one common methane (and water) conduit, typically for separation on the surface installation.

With the assembly according to the first aspect of the invention, there is no need for a tubing hanger, since the tubing is connected to the well control package. Thus, one avoids lowering the tubing hanger, with the tubing depending down from it, down to the wellhead for landing subsea. Instead, the tubing is installed by landing the well control package (WCP) on the wellhead.

In some embodiments, the methane conduit will be a rigid riser string.

In other embodiments, the methane conduit can be a flexible umbilical. In such embodiments, the umbilical may be connected via an umbilical termination head and a jumper.

A surface flow tree can advantageously be arranged on the upper end of the methane conduit, and below a drill floor of the surface installation.

Such positioning may typically be at the elevation of the moon pool deck or below the sea surface.

In some embodiments of the first aspect of the invention, a flexible hose may extend from the surface and down to an annulus bore of the emergency disconnection package. The annulus bore of the emergency disconnection package communicates with the annulus bore of the well control package. Moreover, the annulus bore of the well control package can then communicate with the tubing.

In such an embodiment, methane and water can be separated subsea, and water will be transported through the flexile hose, while methane will be transported through the methane conduit.

In some embodiments, the well control package main bore can be in direct fluid communication with the annulus outside the tubing, along the entire length of the tubing. This means that there is no wellbore packer that seals off the annulus outside the tubing.

In embodiments including the rigid riser string, a main bore of the well control package can be in fluid communication with the rigid riser string. Moreover, a well control package annulus bore can be in fluid communication with an annulus hose. The tubing can then be connected to the well control package annulus bore.

In other embodiments, the well control package annulus bore can be in direct fluid communication with the annulus outside the tubing, along the entire length of the tubing.

In embodiments including an annulus hose, it will advantageously extend from the surface installation and connect to the emergency disconnection package. In such embodiments, the annulus hose, the emergency disconnection package, the well control package and the tubing may constitute a continuous fluid path between the submersible pump and the surface installation.

Advantageously, in the offshore methane hydrate production assembly according to the invention, the tubing is connected to a part of the well control package by means of a connector. This shall be construed as not being connected to a tubing hanger which is landed at the subsea position, such as in the wellhead.

According to a second aspect of the present invention, a method of providing a methane hydrate production string or conduit extending between a subsea methane hydrate formation and a surface installation is disclosed. A drilled well extends between the methane hydrate formation and the seabed. The method comprises the following steps:

a) joining tubing pipe segments into a tubing string, and arranging a submersible pump as a part of the tubing string;
b) suspending the tubing string from the surface installation;
c) connecting a lower end of a landing string to an emergency disconnection package which is arranged above a well control package;
d) landing and connecting the well control package on top of the tubing string, while the tubing string is suspended from the surface installation;

e) on the landing string, lowering the tubing string into the well, until the well control package lands on a wellhead on top of said well.

According to the second aspect of the invention, step e) comprises lowering the tubing string in open water.

The landing string used to lower the tubing string in step e), can in some embodiments be a riser string which is maintained as a part of the methane hydrate production string when the tubing string is installed in the well.

In other embodiments, the landing string used to lower the tubing string in step e) can be a landing wire.

In some embodiments of the method, step c) can involve connecting the lower end of the riser string to an emergency disconnection package main bore. Moreover, step d) may involve connecting the tubing string to a well control package annulus bore.

With the method according to the second aspect of the invention, step b) may comprise i) suspending the tubing string in an installation skid at a lower deck;

and step c) may comprise ii) joining riser joints at an upper deck or preparing a landing wire;

iii) moving the installation skid out of a well center position below the upper deck;

iv) moving a stack comprising the well control package (WCP) and the emergency disconnection package (EDP) into the well center position below the upper deck;

v) connecting the landing string to the emergency disconnection package and suspending the stack on the landing string;

and step d) may comprise vi) moving the installation skid back into the well center position;

vii) landing the stack onto the installation skid.

In such embodiments, step d) may even further comprise one of the following steps:

viii) by means of an elevation arrangement on the installation skid, engaging a lower portion of the well control package with a connector on the tubing string; or ix) by means of the derrick winch, lowering the well control package, while suspended on the landing string, onto a connector on the tubing string.

In some embodiments of this method, the landing string can be an assembly of riser joints that are connected to the EDP and WCP. In other embodiments, the landing string can be a wire connected to a derrick winch.

According to a third aspect of the present invention, disclosed is a method of providing a methane hydrate production assembly between a surface installation and a methane hydrate formation, wherein a subsea well extends down to the methane hydrate formation. According to the third aspect of the invention, the method comprises running a tubing and a riser string in one single run.

According to a fourth aspect of the present invention, disclosed is a method of landing a tubing in a subsea well extending down to a methane hydrate formation. The method further involves landing a stack comprising the tubing, a well control package from which the tubing is suspended, and an emergency disconnection package, on a landing wire by means of a winch.

According to a fifth aspect of the invention, an installation skid is provided, which has a base structure. According to the fifth aspect of the invention, the base structure has a cutout, and a C-plate is arranged in the cutout.

The base structure can typically be in the form of a base plate.

The C-plate shall be understood as a component adapted to receive and support a pipe string which is suspended from the C-plate. Thus, the C-plate may have other shapes than the shape of the letter c. Moreover, it shall be possible to move the pipe string into the supported position with a horizontal movement. That is, the operator may move the pipe string, for instance while being suspended in a winch cable/winch wire, in a lateral direction into the C-plate. He may then land the pipe string in a receiving profile in the C-plate before detaching the winch cable/winch wire.

In an embodiment of the fifth aspect of the invention, the C-plate is adapted to be removably supported in the cutout. Since the C-plate is removable, the operator may select a C-plate which is adapted to receive and support the pipe string in question. Typically the pipe string may be a tubing string depending down from a surface installation.

In another embodiment, the installation skid comprises support posts which have support platforms. The support platforms are adapted to be locked to the support posts in different vertical positions.

In such an embodiment, the support platforms can be functionally connected to hydraulic pistons, by means of which the vertical elevation of the support platforms are adjustable. Each support post may thus comprise a separate hydraulic jack. The operator can with such means be able to land a well control package softly on top of a suspended tubing string (hanging from the C-plate). Alternatively, the operator may lower the well control package gently by means of the derrick winch, onto the tubing string connector.

EXAMPLE OF EMBODIMENT

While the various aspects of the invention have been discussed in general terms above, some detailed examples of embodiments are given in the following with reference to the drawings, in which FIG. 1 is a schematic view of an offshore methane hydrate production assembly according to the invention;

Figure 1:
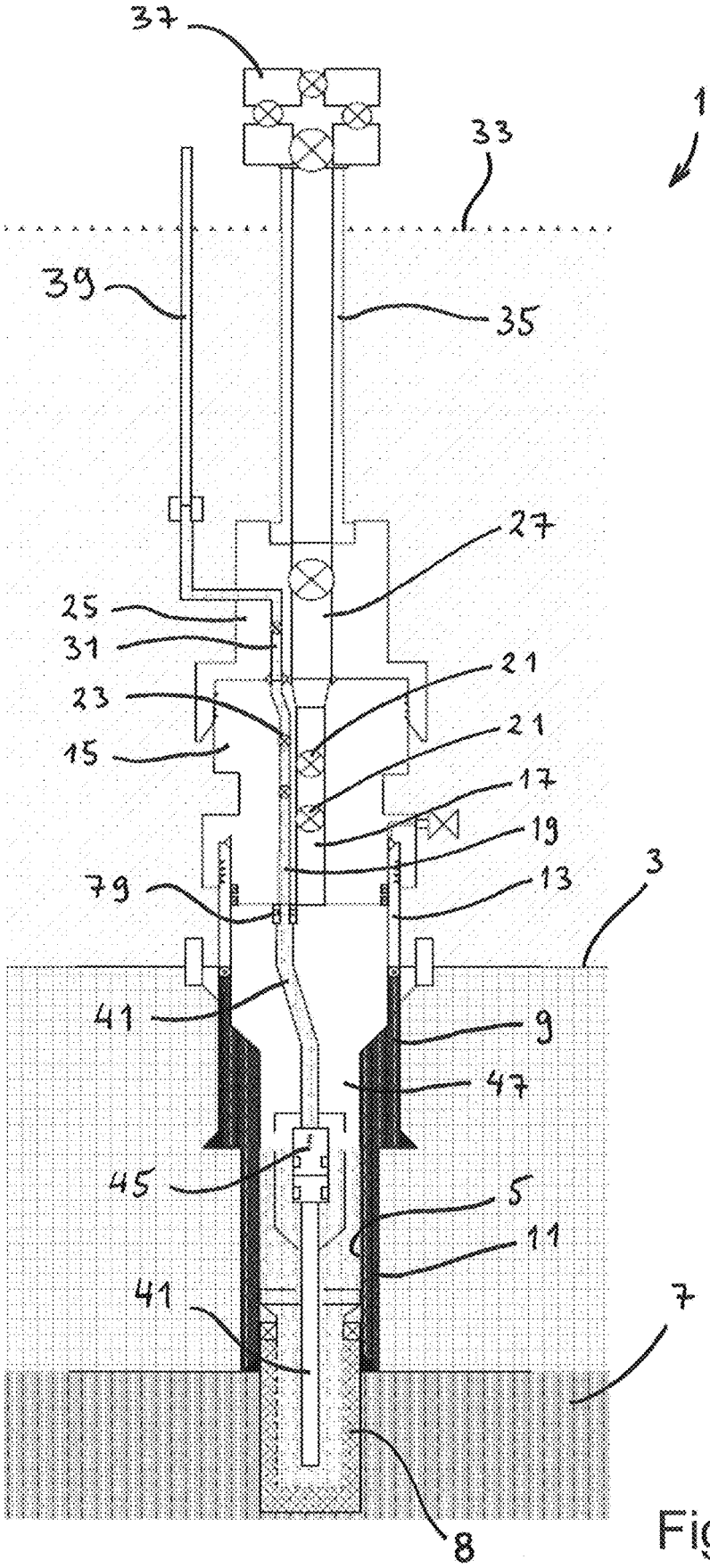

FIG. 1 is a schematic illustration of an offshore methane hydrate production assembly 1 according to the present invention. In the seabed 3, a well 5 has been drilled down to a methane hydrate formation 7. The methane hydrate formation 7 may typically be about 300 meters below the seabed 3. The sea depth may typically be about 1000 meters. Thus, a significant pressure is present at the seabed and within the well.

An assembly of conductor pipe 9 and casing 11 extends from a wellhead 13 at the seabed 3 and down to the formation 7.

A well control package 15 is landed above the wellhead 13. The well control package (WCP) 15 has a WCP main bore 17 and a WCP annulus bore 19. In the main bore 17 there are two main bore valves 21. In the annulus bore 19 there are two annulus bore valves 23. Advantageously, neither the main bore valves 21, nor the annulus bore valves 23, have cutting capabilities. Compared to other known well control packages, these valves and the WCP itself may thus be lighter than WCP's that have cutting valves.

An emergency disconnection package (EDP) 25 is landed on top of and secured to the WCP 15. The EDP 25 has an EDP main bore 27 that aligns with the WCP main bore 17. Within the EDP main bore 27 there is arranged a main bore retainer valve 29. Also within the EDP 25 is an EDP annulus bore 31 which aligns with the WCP annulus bore 19.

Figure 2:
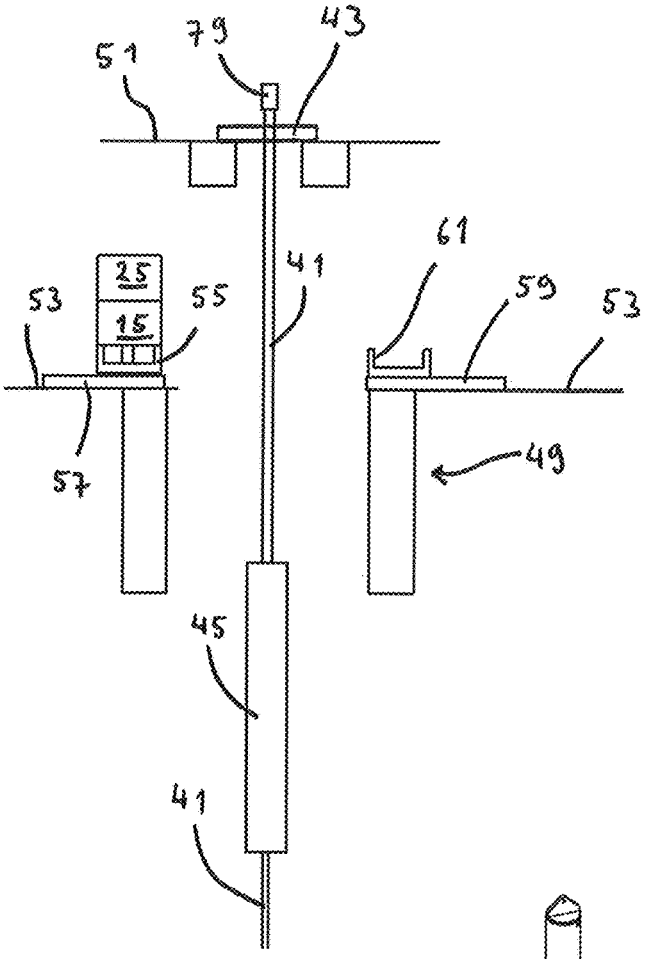
FIG. 2 is a schematic view of a surface installation, in a situation where the operator is mounting the assembly depicted in FIG. 1.

Between the EDP 25 and the sea surface 33 extends a riser string 35. The riser string 35 is suspended to a surface installation. In this embodiment, the surface installation is a floating installation (The surface installation is not shown in FIG. 1, but is indicated in FIG. 2). At the upper portion of the riser string 35, a surface flow tree 37 is arranged.

Also extending between the EDP 25 and the surface installation is an annulus hose 39. Although not shown in FIG. 1, the annulus hose 39 may preferably be clamped onto the riser string 35 (cf. FIG. 10).

Hanging down from the WCP 15 is a tubing 41. The tubing 41 extends down to the methane hydrate formation 7.

The tubing 41 is connected to the WCP annulus bore 19. As a result, the annulus 47, between the tubing 41 and the casing 11, is in fluid communication with the WCP main bore 17 and hence the riser string 35 (through the EDP main bore 27). This is in contrast to workover operations known from the field of common oil and gas wells, where the tubing connects to the main bore and the annulus communicates with the annulus bore.

Some distance above the lower end of the tubing 41, an electrical submersible pump (ESP) 45 is arranged in the string of tubing 41. Instead of an electrical pump, one could also use another type of pump, for instance a hydraulically operated pump.

The ESP 45 is used to pump fluid upwards through the tubing 41. This lowers the pressure in the formation, making the methane hydrate dissolve into water and methane. In addition to the pumping function, the ESP 45 also exhibits a separation means. With the separation means, the ESP 45 separates water and methane. Thus, the ESP 45 is able to pump the water up through the tubing 41. Separated methane will rise up through the annulus 47. Consequently, methane is transported towards the surface flow tree 37 through the annulus 47, the WCP main bore 17, the EDP main bore 27 and the riser string 35. The water is transported towards the surface installation through the tubing 41, the WCP annulus bore 19, the EDP annulus bore 31, and the annulus hose 39. The ESP 45 may typically constitute some tens of meters of the tubing string 41.

At the position of the methane hydrate formation 7, a perforated pipe 8 is arranged in the well 5. The perforated pipe 8 maintains the integrity of the well 5, while letting water and methane pass through it, to enter the wellbore from the formation 7.

FIG. 2 and FIG. 4 to FIG. 9 are schematic views of a method of providing an offshore methane hydrate production assembly 1 that extends between the methane hydrate formation 7 and a surface installation. Reference is first made to FIG. 2, which schematically depicts a surface installation 49, here in the form of a floating installation, such as a ship with a moon pool. In shallow waters, an installation standing on the seabed may be used instead.

The surface installation 49 has an upper deck 51 and a lower deck 53. In this embodiment, the upper deck is a drill floor 51 and the lower deck is a moon pool deck 53. Other applicable surface installations may have other types of upper and lower decks.

In the situation shown in FIG. 2, the tubing 41 has been made up at the drill floor 51, comprising the ESP 45 some distance above the lower end of the tubing 41.

In this situation, the tubing 41 hangs from the drill floor 51, through the moon pool deck 53 and for example about 300 meters down into the sea. The tubing 41 is supported at the drill floor 51 by means of a pipe hang-off arrangement 43. On the lower deck, or the moon pool deck 53, the EDP 25 is installed on top of the WCP 15, resting on a well control package skid (WCP skid) 55. The WCP skid 55 is supported on a first cart 57. The first cart 57 may typically be a BOP cart (blowout preventer cart).

On the moon pool deck 53 there is also a second cart 59. The second cart 59 supports an installation skid 61.

Figure 3:
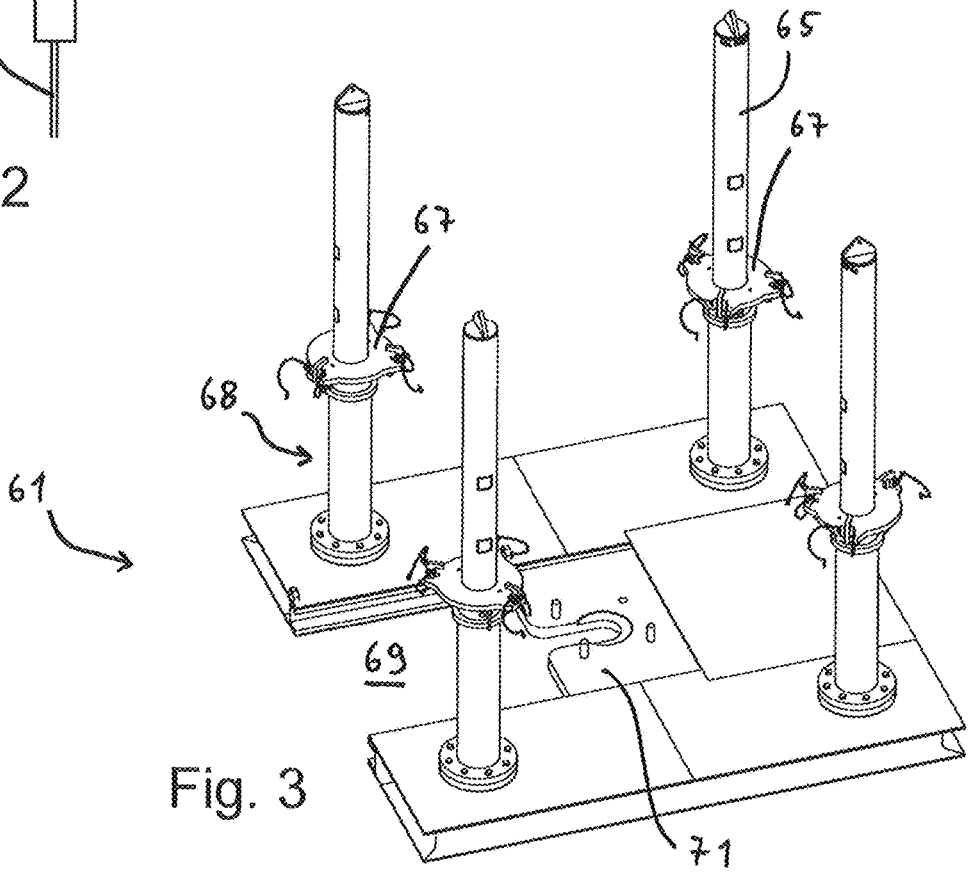
FIG. 3 is a perspective view of an installation skid, used to suspend a tubing string from a surface installation.

FIG. 3 illustrates the installation skid 61 with a perspective view. It has a base frame 63. Extending upwardly from the base frame 63 are four support posts 65. The support posts 65 are equipped with support platforms 67. The installation skid 61 is adapted to receive and support the WCP 15, as will be discussed further below. In such a position, the WCP 15 is supported on the support platforms 67. The elevation of the support platforms 67 may be adjusted, thereby adjusting the elevation of the WCP 15, when landed on the installation skid 61. The elevation of the support platforms 67 is adjusted by means an elevation arrangement 68. In one embodiment, the elevation arrangement 68 may comprise hydraulic pistons arranged within each support post 65. With such an elevation arrangement 68, the operator is able to adjust the vertical position of the WCP 15 while being supported on the installation skid 61.

The base frame 63 comprises an open slot 69. The open slot 69 is laterally accessible from one side of the base frame 63. Moreover, a C-plate 71 is arranged in the open slot 69 and is adapted to receive and carry the weight of the tubing 41. The tubing 41 may enter the open slot 69 and the C-plate 71 laterally, by being moved into the open slot 69. Preferably, the C-plate 71 is a separate part which can be releasably fixed in the open slot 69. Thus, the operator may elect a C-plate 71 which fits to the dimension of the tubing 41. As the skilled person will appreciate, the second cart 59 must also be able to receive the tubing 41, with an open slot or void (not shown).

Figure 4:
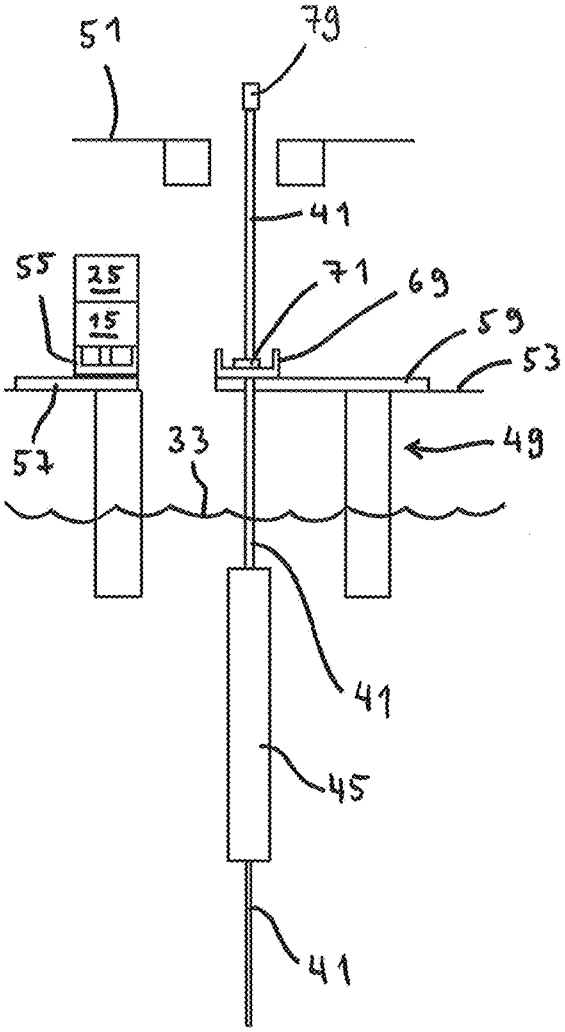
FIG. 4 to FIG. 9 are schematic views corresponding to FIG. 2, illustrating the assembly process of the production assembly.

In the situation shown in FIG. 4, the installation skid 61 has been moved with the second cart 59, so that the tubing 41 is positioned within the open slot 69 and the C-plate 71. Still however, the tubing is supported from the drill floor 51.

Figure 5:
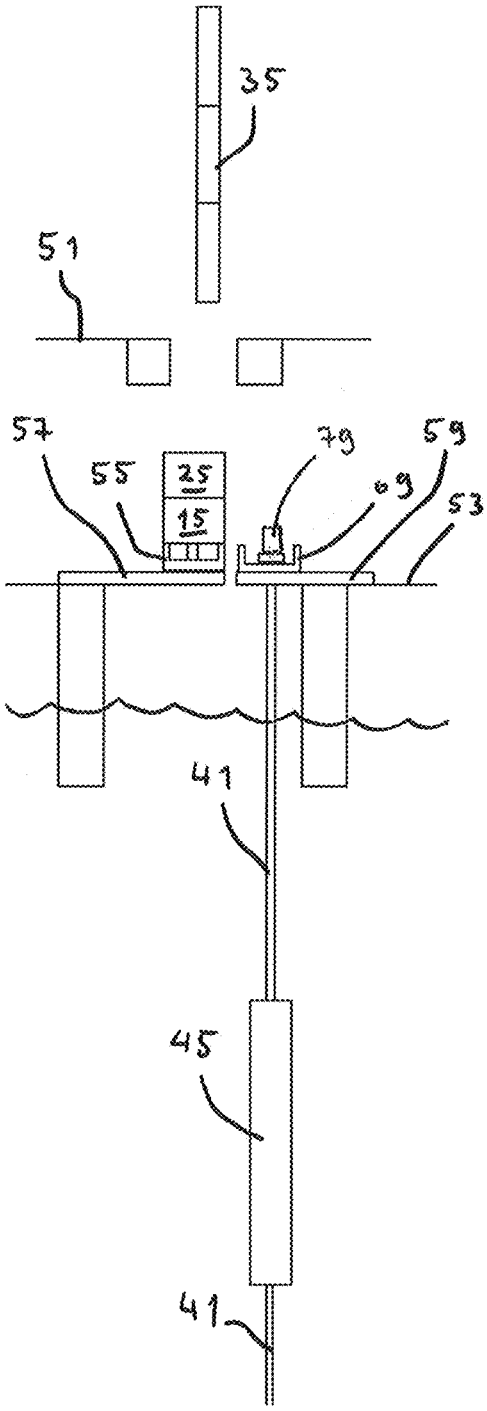

In FIG. 5, the tubing 41 has been lowered, so that a hang off shoulder 73, arranged at the upper end of the tubing 41, is hung off in the C-plate 71 in the installation skid 61. The C-plate 71 has a receiving profile that engages the hang off shoulder of the tubing 41, transferring the weight forces of the tubing 41 to the installation skid 61, via the C-plate 71. The lowering of the tubing 41 is typically performed with a derrick winch (not shown), above the drill floor 51.

Still referring to FIG. 5, the second cart 59 is moved so that the installation skid 61, along with the tubing 41 hanging down from it, is removed from the position directly below the well center of the drill floor 51. This makes it possible to move the WCP 15 and the EDP 25, which are supported on the WCP skid 59, into the well center of the moon pool (or the lower deck 53) (i.e. directly below the well center of the drill floor 51). This movement is performed by moving the first cart 57.

After the tubing 41 has landed in the installation skid 61, the operator can start building the riser string 35 in the derrick, i.e. at the drill floor 51. FIG. 5 depicts three riser joints above the drill floor 51, of which the lowermost is a stress joint and the other two are standard riser joints.

Figure 6:
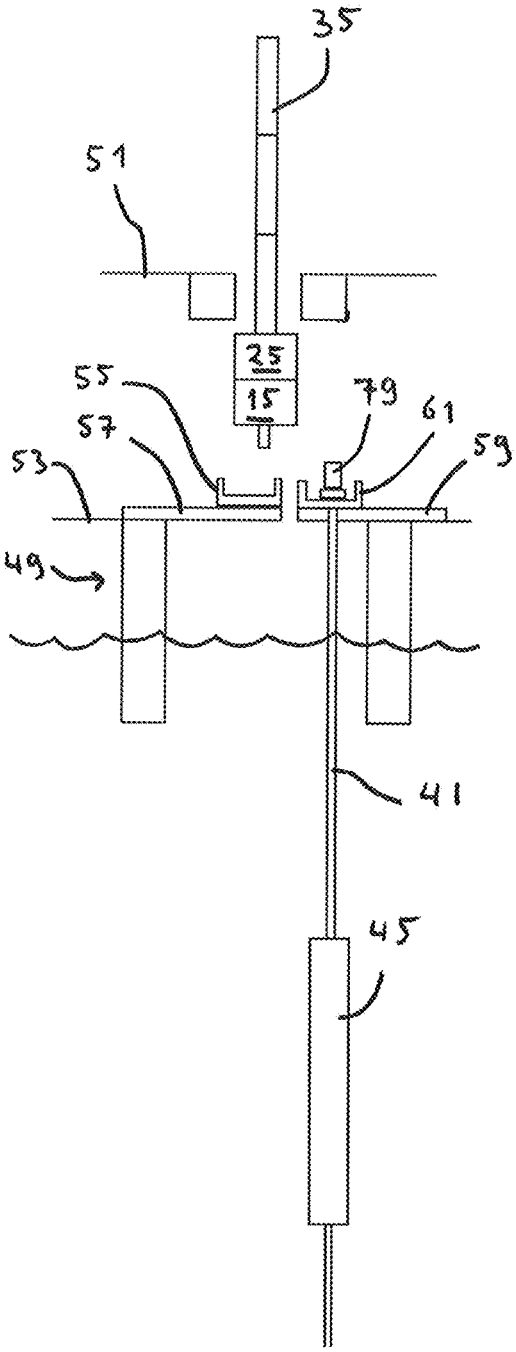

Referring now to FIG. 6. After building a certain length of riser joints, the lower end of the riser 35 (i.e. the stress joint) is connected to the EDP 25, which is supported on the WCP skid 55. After connection, the WCP 15 and the EDP 25 are lifted off the WCP skid 55, and the WCP skid 55 is removed by moving the first cart away from the well center.

Figure 7:
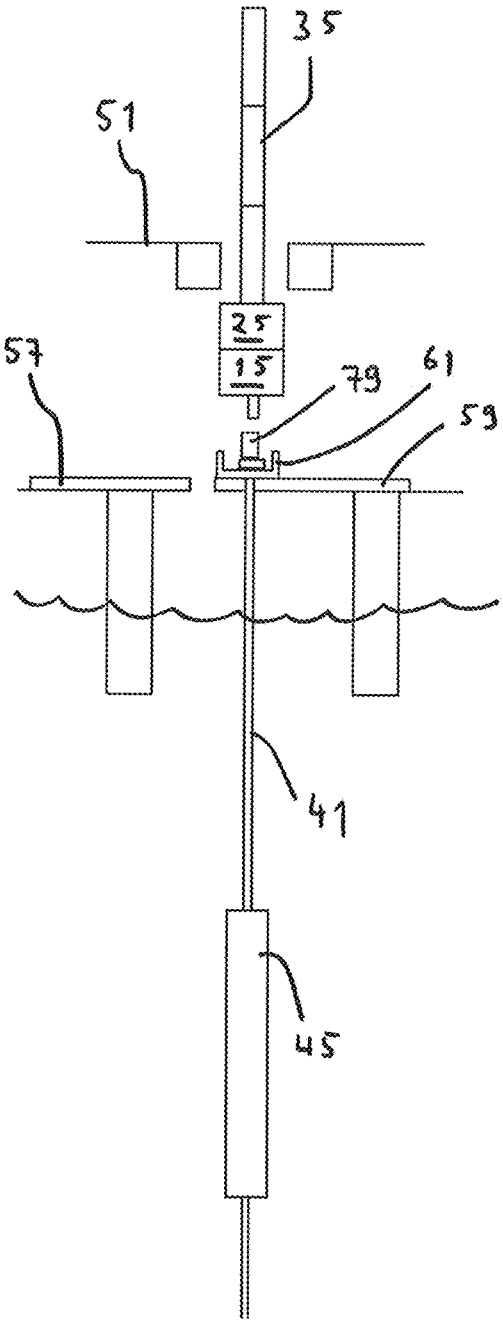
Figure 8:
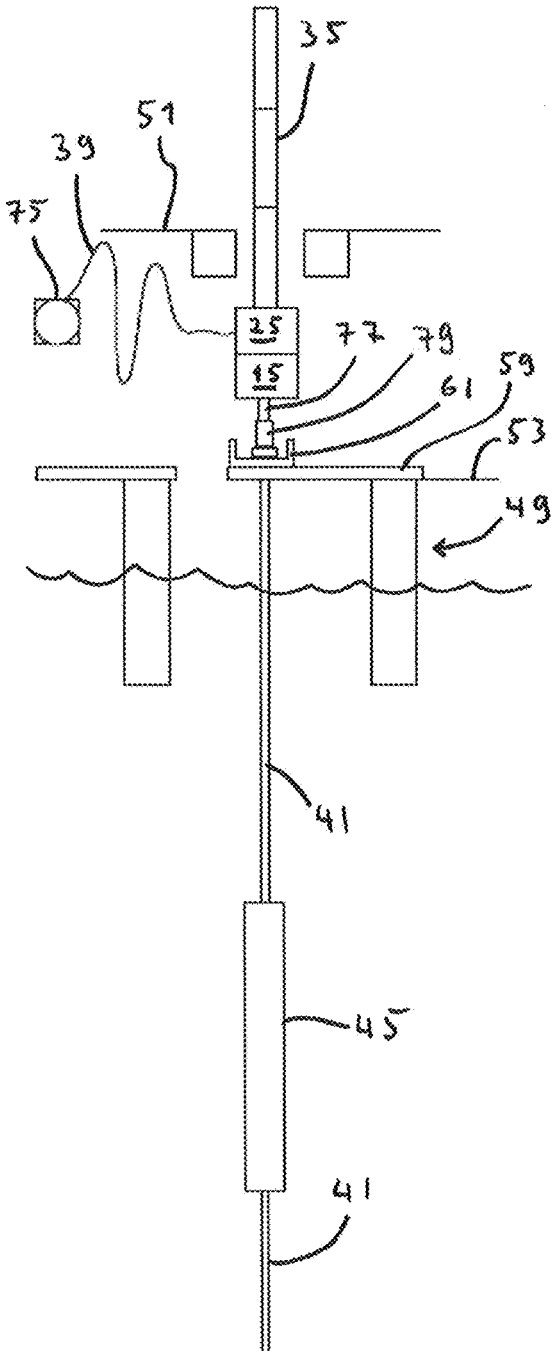

As shown in FIG. 7, the installation skid 61 is moved into the well center, below the WCP 15 and EDP 25, which are now suspended in the riser 35. Then, the WCP 15 and EDP 25 can be lowered towards the upper end of the tubing 41 which is hung off in the installation skid 61. FIG. 8 illustrates the situation wherein the WCP 15 has been connected to the upper end of the tubing 41. Advantageously, the connection is made by locking a pup joint 77 at the lower end of the WCP 15 to a connector 79 at the upper end of the tubing 41 (cf. FIG. 11 to FIG. 13).

Figure 9:
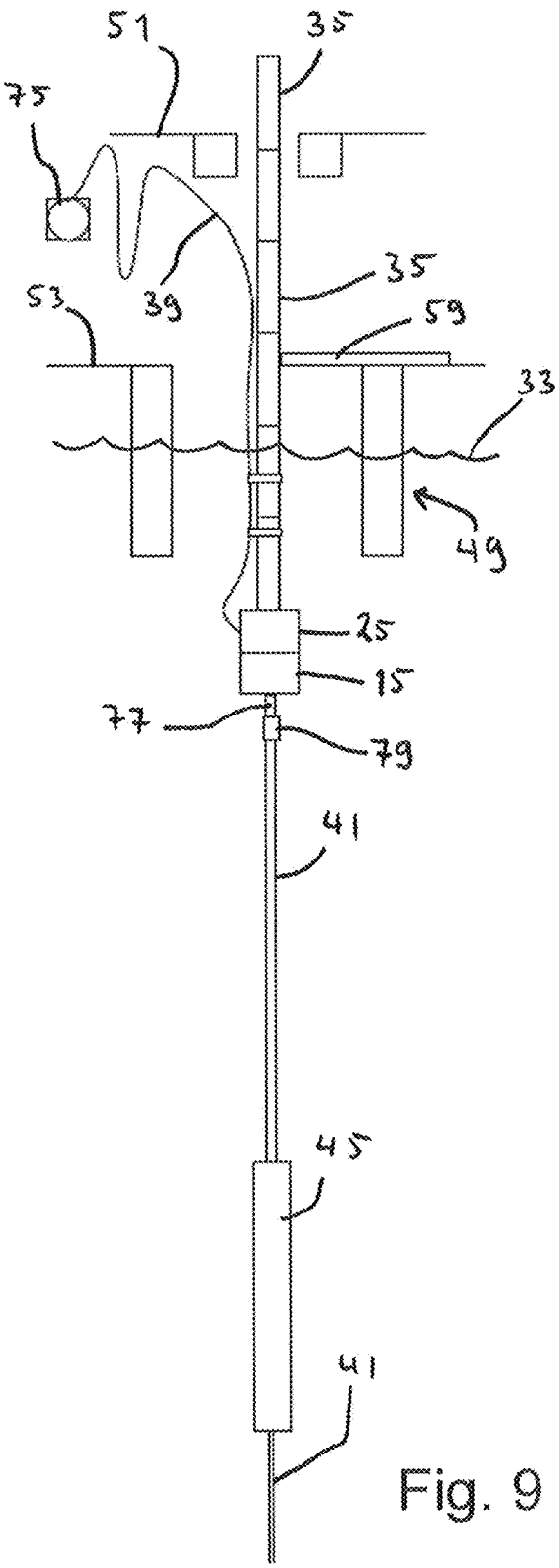

After the connection has been made, the entire string comprising the tubing 41, WCP 15, EDP 25 and the lower part of the riser string 35 can be lifted off the installation skid 61, as shown in FIG. 9. The installation skid 61, along with the second cart 59 are removed from its position in the well center, below the drill floor 51. The assembly can then be lowered into the sea, while the riser string 35 is built by joining riser joints.

As shown in FIG. 8 and FIG. 9, the annulus hose 39 is connected to the EDP 25. As the string is lowered into the sea, as shown in FIG. 9, the annulus hose 39 is clamped to the riser string 35, and reeled out from a reel 75.

When the lower end of the tubing 41 reaches the upper end of the well 5, the well is open and filled with water. Thus, after ensuring that the lower end of the tubing 41 is inserted into the well, i.e. the wellhead 13, the operator continues to lower the string until the WCP 15 lands on the wellhead 13. Typically, a remotely operated vehicle (ROV) may be used to monitor and to guide the tubing into the wellhead 13.

When the WCP 15 has landed on the wellhead 13, it is secured to the wellhead 13 and seals are activated in order to make a confined fluid path between the tubing annulus 47 and the WCP main bore 17. This situation is schematically depicted in FIG. 1. Before starting production, water is removed from the annulus 47. This is typically performed by injecting nitrogen through the riser and into and out from the tubing 41. Water is then transported out through the annulus hose 39. After flushing the annulus with nitrogen, production may commence by operation of the EDP 25.

Figure 10:
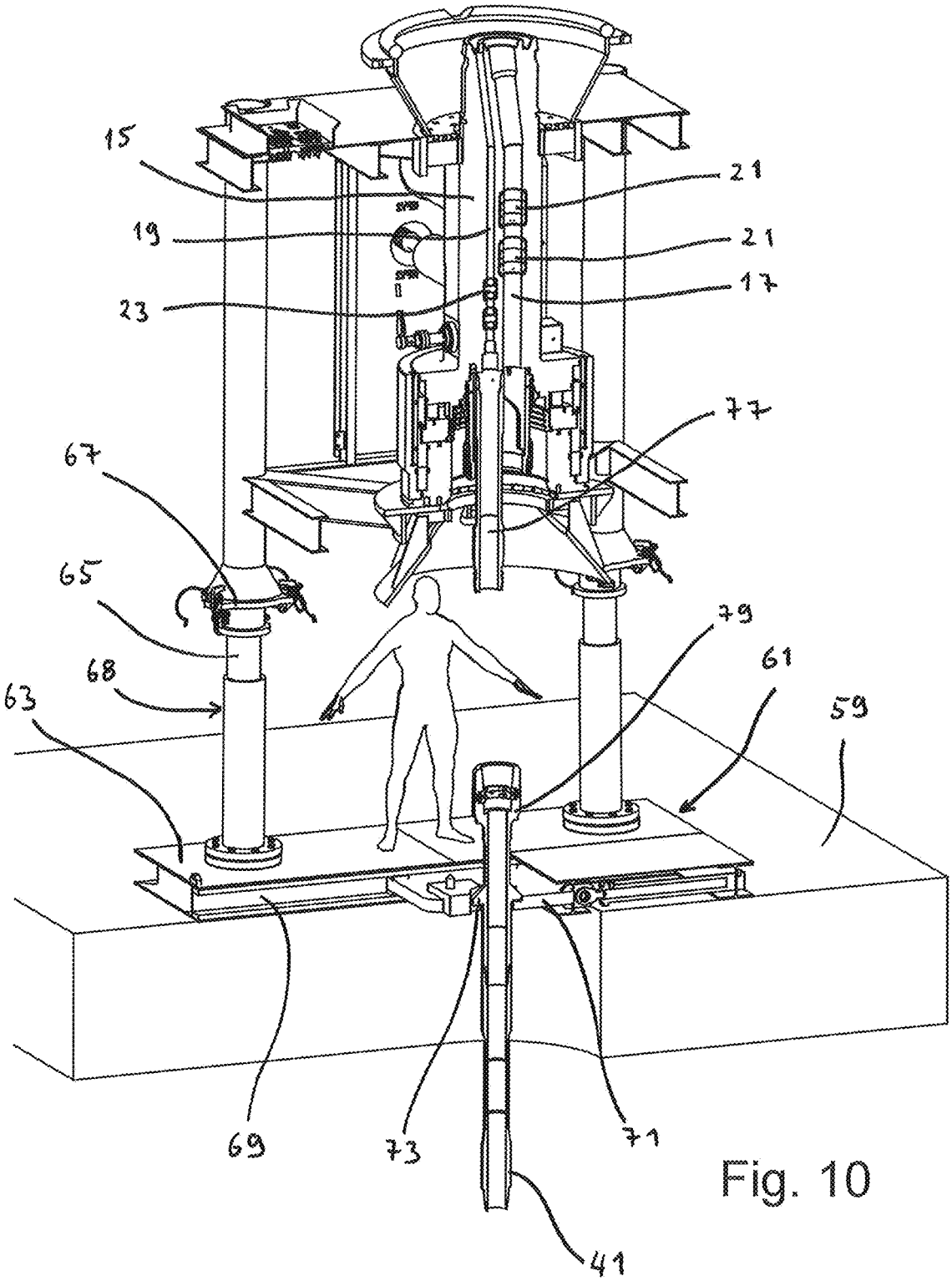
FIG. 10 is a perspective view of a well control package landed on an installation skid, before connecting to the tubing string.
Figure 11:
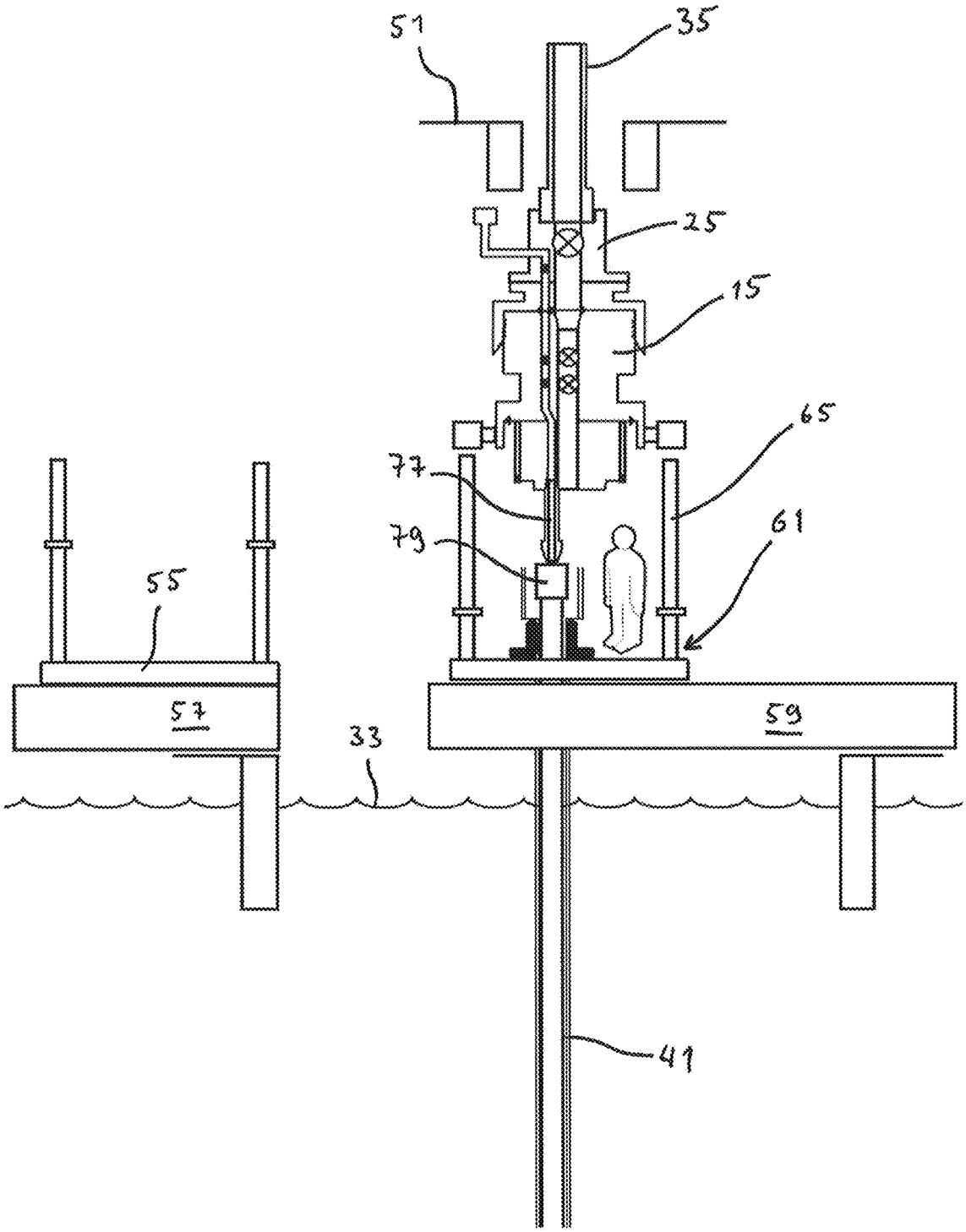
FIG. 11 is a side view of the well control package shown in FIG. 10, the well control package being suspended on the lower end of a riser string.

FIG. 10 and FIG. 11 illustrate the WCP 15, installation skid 61 and the second cart 59 (FIG. 11).

A pup joint 77, which forms a lower part of the WCP 15, is about to enter the upper end of the tubing 41, namely a connector 79 directly above the hang off shoulder 73. The hang off shoulder 73 rests on a receiving profile of the C-plate 71.

Notably, the pup joint 77 is connected to the annulus bore 19 of the well control package 15. The annulus hose 39 connects to the annulus bore 31 of the emergency disconnection package 25.

Figure 12:
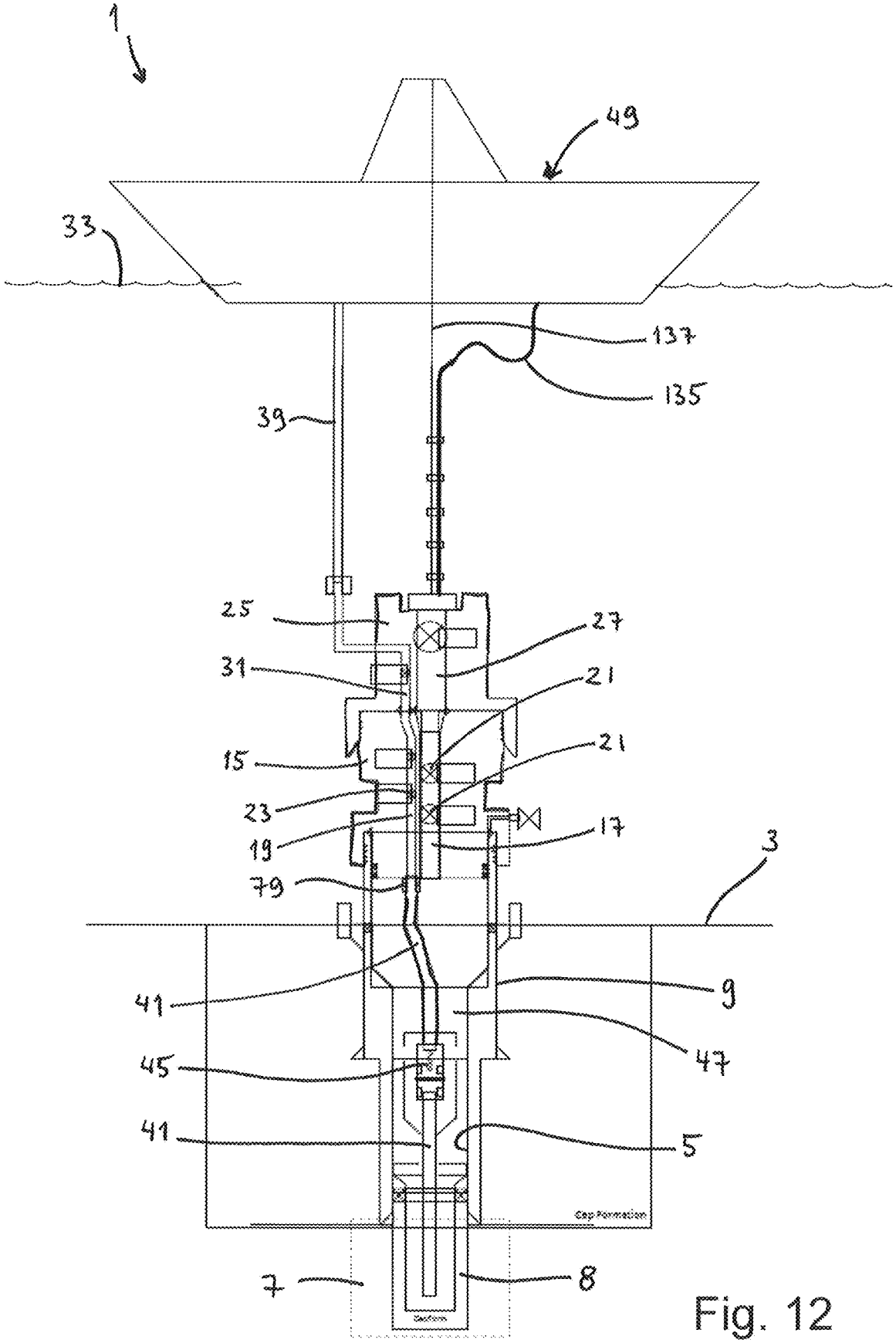
FIG. 12 is a schematic view of an alternative offshore methane hydrate production assembly according to the invention, without a riser.
Figure 13:
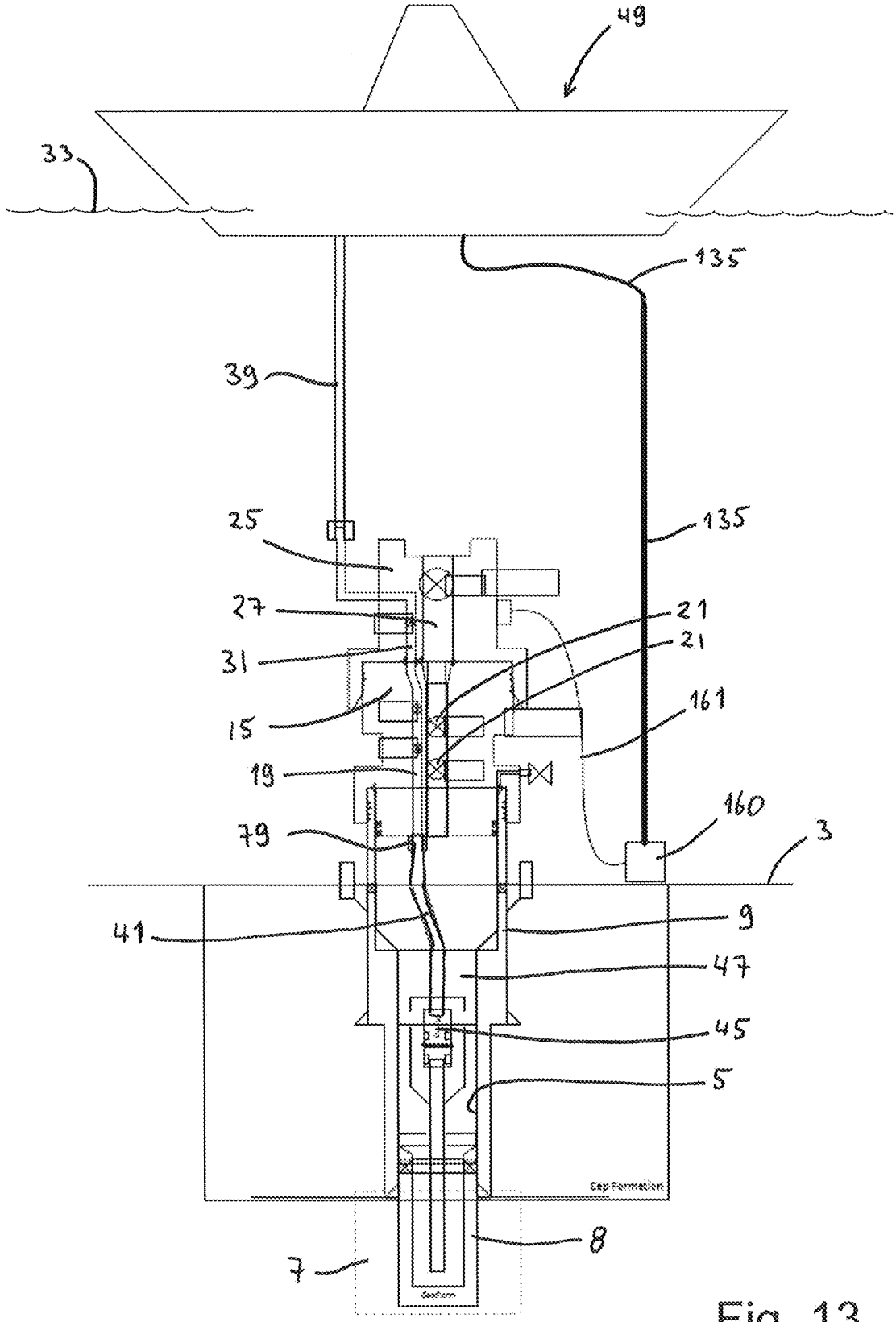
FIG. 13 is a schematic view of the embodiment shown in FIG. 12, after installation.

FIG. 12 and FIG. 13 depict embodiments of the invention where a string of riser, such as riser 35 shown in FIG. 1, is not used. Instead, the assembly of the emergency disconnection package 25, the well control package 15, and the tubing 41, is lowered on a landing wire (not shown). The landing wire can be connected to a crane on the surface installation 49.

In the embodiment shown in FIG. 12, the annulus hose 39 connects to the annulus bore 31 of the EDP 25, which further communicates with the annulus bore 19 of the WCP 15. The annulus bore 19 of the WCP 15 further connects to the tubing 41. This compares to the embodiment shown in FIG. 1, which was discussed above. Instead of having the riser 35, as in FIG. 1, connected to the main bore 27 of the EDP 25, a flexible umbilical 135 connects to this main bore 27. Thus, two flexible conduits are extended between the EDP 25 and the surface installation 49, namely the annulus hose 39 and the flexible umbilical 135. Methane is transported through the flexible umbilical 135, while water is transported through the flexible hose 39.

To ensure stability to the flexible umbilical 135, it is clamped to a pod wire 137 which is extended between the surface installation 49 and the EDP 25.

The embodiment shown in FIG. 13 resembles the embodiment shown in FIG. 12. However, in the embodiment shown in FIG. 13, the flexible umbilical 135 is not clamped to a pod wire. Rather, it is extended down to a umbilical termination head 160. A jumper 161 connects the umbilical termination head 160 to the EDP 25.

Figure 14:
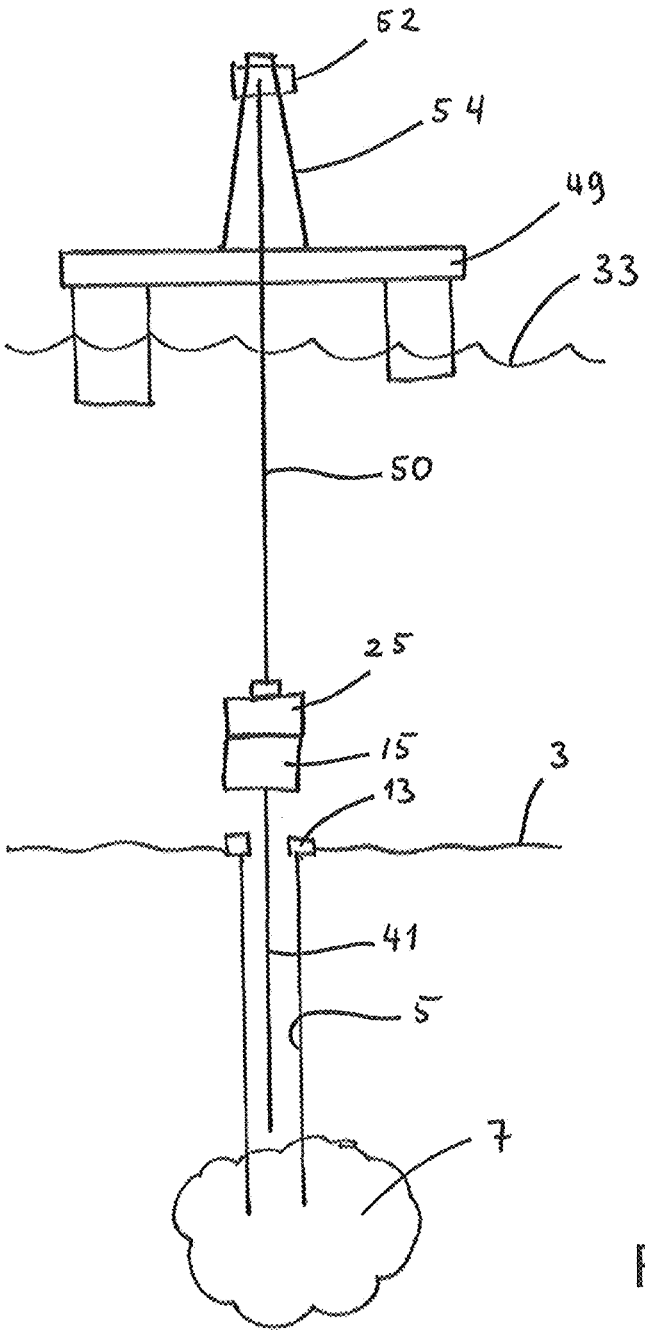
FIG. 14 is a schematic view of a stack, including a tubing, being landed on a wellhead with a landing wire.

FIG. 14 depicts a method of landing a tubing 41 in a subsea well 5 extending down to a methane hydrate formation 7. The method comprises landing a stack comprising the tubing 41, the well control package 15 from which the tubing 41 is suspended, and an emergency disconnection package 25, on a landing wire 50 by means of a derrick winch 52 installed in a derrick 54. Instead of a derrick winch, other embodiments could include a crane. Also, the surface installation 49 could be other types than the one shown in FIG. 14, such as a ship or an installation standing on the seabed. As shown in FIG. 14, there is no barrier between the well 5 and the surrounding seawater in the shown stage. After landing, the WCP 15 will seal with the wellhead 13, thereby sealing off the well 5.

Figure 15:
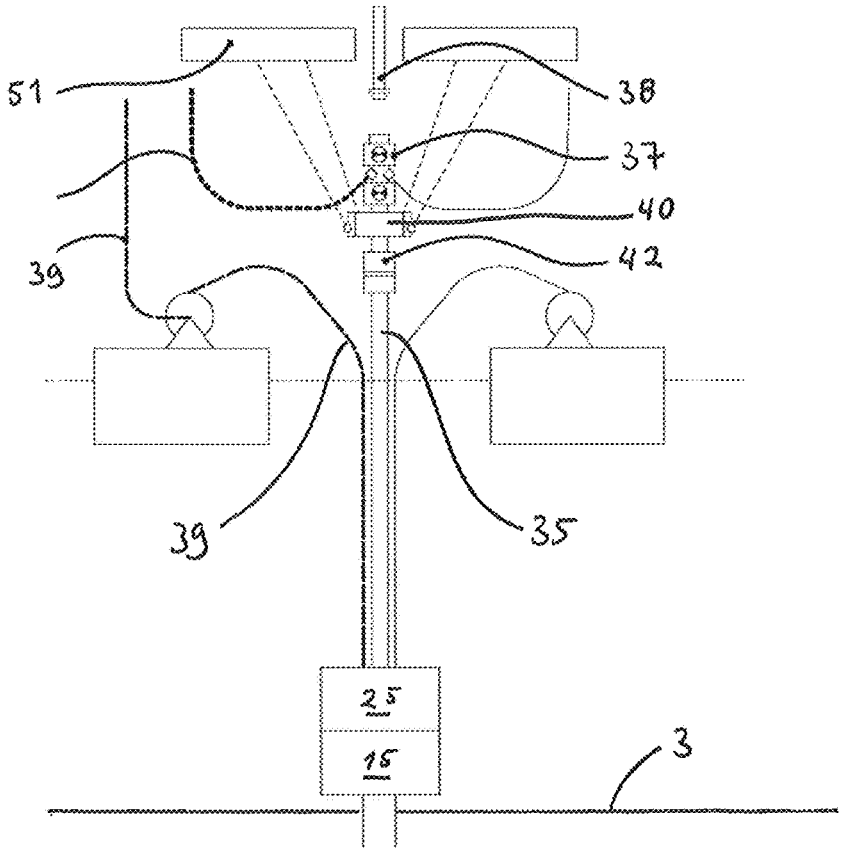
FIG. 15 is a schematic illustration of an advantageous positioning of the surface flow tree.

FIG. 15 depicts an advantageous positioning of the surface flow tree 37. In this embodiment, the surface flow tree 37 is arranged below the drill floor 51. Extending through the drill floor 51 is a landing joint 38. Also indicated is a tension ring 40 and a swivel 42.

The invention claimed is:

1. A method of providing a methane hydrate production string extending between a subsea methane hydrate formation and a surface installation, wherein a drilled well extends between the methane hydrate formation and the seabed, the method comprising:

a) joining tubing pipe segments into a tubing string configured for transporting liquid, and arranging a submersible pump as a part of the tubing string for pumping the liquid through the tubing string;

b) suspending the tubing string from the surface installation;

c) connecting a lower end of a landing string to an emergency disconnection package which is arranged above a well control package;

d) landing and connecting, at the surface installation, the well control package with a connector to an upper end of the tubing string, while the tubing string is suspended from the surface installation; and e) on the landing string, lowering the tubing string from the surface installation through the open water into the well until the well control package lands on a wellhead on top of said well.

2. The method according to claim 1, wherein the landing string used to lower the tubing string in step e), is a riser string which is maintained as a part of the methane hydrate production string when the tubing string is installed in the well.

3. The method according to claim 1, wherein the landing string used to lower the tubing string in step e), is a landing wire.

4. The method according to claim 2, wherein:

step c) comprises connecting the lower end of the riser string to an emergency disconnection package main bore; and step d) comprises connecting the tubing string to a well control package annulus bore.

5. The method according to claim 1, wherein:

step b) comprises:

i) suspending the tubing string in an installation skid at a lower deck;

step c) comprises:

ii) joining riser joints at an upper deck or preparing a landing wire;

iii) moving the installation skid out of a well center position below the upper deck;

iv) moving a stack comprising the well control package and the emergency disconnection package into the well center position below the upper deck;

v) connecting the landing string to the emergency disconnection package and suspending the stack on the landing string;

and step d) comprises:

vi) moving the installation skid back into the well center position; and vii) landing the stack onto the installation skid.

6. The method according to claim 5, wherein step d) comprises one of the following steps:

viii) by means of an elevation arrangement on the installation skid, engaging a lower portion of the well control package with a connector on the tubing string; and ix) by means of a derrick winch, lowering the well control package, while suspended on the landing string, onto a connector on the tubing string.

7. The method according to claim 1, wherein the upper end of the tubing string is not connected to a tubing hanger.

8. The method according to claim 1, wherein the connecting the well control package with the connector to the upper end of the tubing string comprises, connecting a pup joint extending below the well control package to the connector at the upper end of the tubing.

* * * * *